US009340393B2

(12) United States Patent
Chi

(10) Patent No.: US 9,340,393 B2
(45) Date of Patent: May 17, 2016

(54) METHOD FOR MEASURING OPENING AND CLOSING DELAY TIME OF ELEVATOR BRAKE

(71) Applicant: LSIS CO., LTD., Anyang-si, Gyeonggi-do (KR)

(72) Inventor: Min Hun Chi, Gunpo-si (KR)

(73) Assignee: LSIS CO., LTD., Anyang-si (KR)

( * ) Notice: Subject to any disclaimer, the term of this patent is extended or adjusted under 35 U.S.C. 154(b) by 8 days.

(21) Appl. No.: 14/444,839

(22) Filed: Jul. 28, 2014

(65) Prior Publication Data

US 2015/0059460 A1 Mar. 5, 2015

(30) Foreign Application Priority Data

Aug. 29, 2013 (KR) ..... 10-2013-0102911

(51) Int. Cl.
*B66B 5/00* (2006.01)
*B66B 1/32* (2006.01)

(52) U.S. Cl.
CPC ..... *B66B 5/0037* (2013.01); *B66B 1/32* (2013.01)

(58) Field of Classification Search
CPC ..... B66B 1/32; B66B 5/0031; B66B 5/0037; B60T 17/221; B60T 2270/406
USPC ..... 73/121
See application file for complete search history.

(56) References Cited

U.S. PATENT DOCUMENTS 4,974,703 A 12/1990 Nomura
4,984,659 A * 1/1991 Nomura ..... B66B 1/32 187/288
8,205,721 B2 * 6/2012 Korhonen ..... B66B 1/32 187/288
8,727,075 B2 * 5/2014 Huppunen ..... B60T 8/885 187/288

FOREIGN PATENT DOCUMENTS

CN 1038994 1/1990
JP 59-74869 4/1984
JP 02-008175 1/1990

(Continued)

OTHER PUBLICATIONS

European Patent Office Application Serial No. 14180293.4, Search Report dated Feb. 2, 2015, 9 pages.

(Continued)

*Primary Examiner* — Freddie Kirkland, III
(74) *Attorney, Agent, or Firm* — Lee, Hong, Degerman, Kang & Waimey; Jonathan Kang; Richard Salfelder

(57) ABSTRACT

Disclosed is a method for measuring opening and closing delay time of elevator brake, the method including outputting, by a brake signal output unit, a brake signal, receiving, by a brake signal checking unit, the brake signal and determining whether the brake signal is an opening signal or a closing signal to output an opening/closing determination signal, receiving, by a brake counter unit, the opening/closing determination signal, and starting a count for measuring a brake opening time or a brake closing time to accumulate and output counted value, determining, by a motor drive checking unit, whether a motor configured to drive an elevator is driven upon receipt of the counted values and outputting a drive determination signal, and receiving, by a brake opening/closing delay computation unit, the drive determination signal and the counted value to compute a brake opening/closing delay time.

4 Claims, 2 Drawing Sheets

(56) References Cited

FOREIGN PATENT DOCUMENTS

| | | | |
|---|---|---|---|
| JP | 2005-001823 | | 1/2005 |
| JP | 2006-345602 | | 12/2006 |
| JP | 2006345602 | A * | 12/2006 |

OTHER PUBLICATIONS

The State Intellectual Property Office of the People's Republic of China Application Serial No. 201410438128.6, Office Action dated Sep. 6, 2015, 6 pages.

Japan Patent Office Application Serial No. 2014-169390, Office Action dated Jul. 30, 2015, 4 pages.

* cited by examiner

METHOD FOR MEASURING OPENING AND CLOSING DELAY TIME OF ELEVATOR BRAKE

CROSS-REFERENCE TO RELATED APPLICATIONS

Pursuant to 35 U.S.C. §119(a), this application claims the benefit of earlier filing date and right of priority to Korean Patent Application No.10-2013-0102911, filed on Aug. 29, 2013, the contents of which are all hereby incorporated by reference herein in its entirety.

BACKGROUND OF THE DISCLOSURE

1. Field of Endeavor

Exemplary embodiments of the present disclosure relate to a method for measuring opening and closing delay time of elevator brake, and more particularly to a method for measuring opening and closing delay time of elevator brake configured to prevent a roll-back phenomenon of an elevator by automatically calculating elevator brake opening/closing delay time for setting elevator brake opening/closing time, and to allow a stable performance of brake operation.

2. Discussion of the Related Art

Elevators installed inside and/or outside of a building for lifting persons or cargos are mostly of hoist winding type or rope type elevators using friction of wire ropes. The rope type elevator rotates a hoist using rotation force of a motor, where a wire rope contacting the hoist is operated and moved by rotation of the hoist. At this time, torque generated from the motor increases or decreases in response to situations such as persons inside the elevator box, cargo weight or vertical operational directions.

A load imbalance between an elevator car and a balance (counter) weight is continuously generated in the rope type elevator due to loaded weight of persons and cargos in an elevator car, and a heavier force is applied to a direction on a contact surface between a hoist and a wire rope as much as the imbalance, thereby resulting in a moment to be applied to a shaft of the hoist.

A drum type brake applied to an elevator is configured such that a spring is connected to a brake arm, and a brake shoe attached to the brake arm is brought into contact with a brake drum to generate a brake torque, where the brake arm is connected to a brake plunger. The brake shoe is contacted to the brake drum in an elevator to prevent a motor from rotating at a stationary state and a force pressed by the brake shoe to the brake drum is expressed as a compression force of spring.

When a signal is transmitted to a brake driving unit from a controller of an inverter or from an elevator control panel in order to operate an elevator, an electricity is supplied to a brake plunger after a predetermined delayed time, whereby the brake plunger open a brake arm attached to a brake lining to start the operation of the elevator.

Meantime, an elevator brake opening/closing time is an important element for determining a motor control time, and a time delayed until a brake is mechanically opened and closed was arbitrarily set by a user. At this time, the time of the brake being opened and closed is set to be a bit delayed over a time of controlling a motor, where a roll-back phenomenon of an elevator being instantly leaned to a weightier side between an elevator car and a balance weight may be generated, when a brake delay opening and closing time is set at an excessively smaller value. Conversely, although the roll-back phenomenon of the elevator may be prevented when a brake delay opening and closing time is set at an excessively greater value, wear of brake lining disadvantageously increases because the brake shoe is opened after the motor starts to rotate in a state of the brake shoe holding the brake drum.

SUMMARY OF THE DISCLOSURE

Accordingly, the present disclosure is to provided to solve the disadvantages and/or problems of the prior art, and is to provide a system and a method for measuring opening and closing delay time of elevator brake configured to prevent a roll-back phenomenon of an elevator by automatically computing an elevator brake opening/closing delay time for setting elevator brake opening/closing time, and to allow a stable performance of brake operation.

In one general aspect of the present disclosure, there is provided a method for measuring opening and closing delay time of elevator brake, the method comprising:

outputting, by a brake signal output unit, a brake signal;

receiving, by a brake signal checking unit, the brake signal and determining whether the brake signal is an opening signal or a closing signal to output an opening/closing determination signal;

receiving, by a brake counter unit, the opening/closing determination signal, and starting a count for measuring a brake opening time or a brake closing time to accumulate and output counted value;

determining whether a motor configured to drive an elevator is driven upon receipt by a motor drive checking unit of the counted values and outputting a drive determination signal; and receiving, by a brake opening/closing delay computation unit, the drive determination signal and the counted value to compute a brake opening/closing delay time.

Preferably but not necessarily, the method may further comprise, after computing the brake opening/closing delay time, setting, as a brake opening/closing time, the brake opening/closing delay time computed from the computing the brake opening/closing delay time.

Preferably but not necessarily, the brake signal determination signal checking unit, in the outputting the opening/closing determination signal, may output an opening determination signal when the brake signal is an opening signal, and may output a closing determination signal when the brake signal is a closing signal.

Preferably but not necessarily, the brake counter unit, in the accumulating and outputting the counted value, may receive the opening determination signal, may start an opening count for measuring a brake opening time to accumulate and output an opening count value, may receive the closing determination signal, and may start a closing count for measuring a brake closing time to accumulate and output a closing count value.

Preferably but not necessarily, the motor drive checking unit, in the outputting the drive determination signal, may determine whether a motor is driven when the opening count signal is received, may output an operation determination signal as a drive determination signal when the motor is driven, determines whether a motor is stopped when the closing determination signal is received, and may output a stop determination signal as a drive determination signal when the motor is stopped.

Preferably but not necessarily, flow may return to the determining whether the brake signal is an opening signal or a closing signal when the motor is determined not to be driven as a result of determination of whether the motor is driven to determine whether the brake signal is an opening signal, and flow may return to the determining whether the brake signal is an opening signal or a closing signal when the motor is determined not to be stopped as a result of determination of whether the motor is stopped to determine whether the brake signal is a closing signal.

Preferably but not necessarily, the brake opening/closing delay time computation unit may receive the operation determination signal and the opening counter value to compute a brake opening delay time, and may receive the stop determination signal and closing counter value to compute a brake closing delay time.

In an advantageous effect, a brake can be opened and closed at a predetermined time because a delay time can be automatically computed from a point of a brake signal being outputted from a brake signal output unit to a motor being driven or a motor being stopped, and a computed delay time is set at a time when the brake is opened and closed, whereby a roll-back phenomenon, where an elevator is instantly leaned to a weightier side when a brake opening/closing time is implemented earlier, can be prevented.

In another advantageous effect, an increased wear of brake lining generated by an excessive delay of brake opening/closing time can be prevented to enable a stable operation of brake.

DETAILED DESCRIPTION OF PREFERRED EMBODIMENTS

Figure 1:
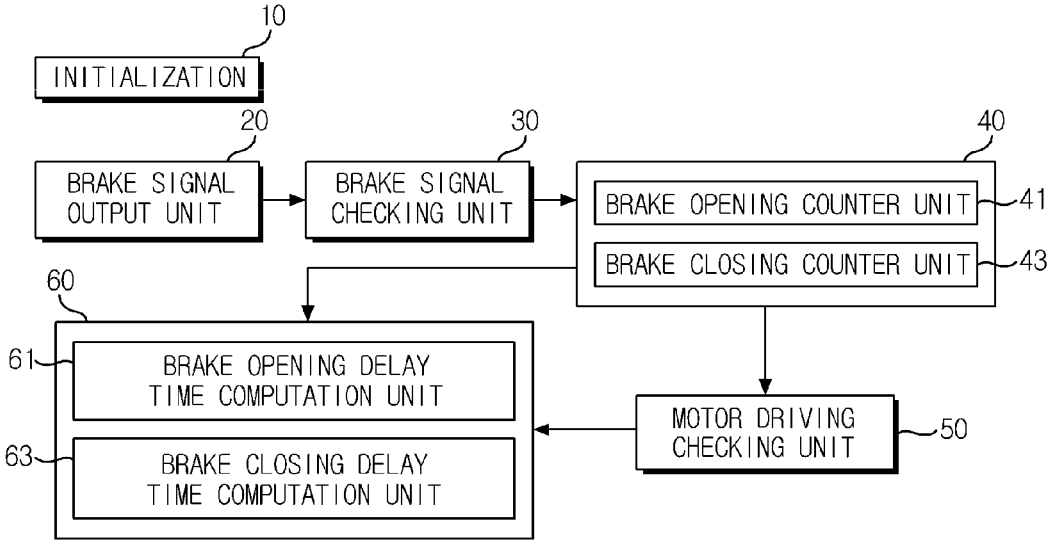
FIG. 1 is a block diagram illustrating a system for measuring an opening/closing delay time of elevator brake according to an exemplary embodiment of the present disclosure.

Now, exemplary embodiments of the present disclosure will be described in detail with reference to the accompanying drawings, so that one of ordinary skill in the art can easily implement the present disclosure upon examination of the figures and detailed description.

Accordingly, detailed descriptions of well-known functions, configurations or constructions are omitted for brevity and clarity so as not to obscure the description of the present disclosure with unnecessary detail. Thus, the present disclosure is not limited to the exemplary embodiments which will be described below, but may be implemented in other forms. In the drawings, the width, length, thickness, etc. of components may be exaggerated or reduced for the sake of convenience. Furthermore, the meaning of specific terms or words used in the specification and claims should not be limited to the literal or commonly employed sense, but should be construed or may be different in accordance with the intention of a user or an operator and customary usages. Therefore, the definition of the specific terms or words should be based on the contents across the specification.

Figure 2:
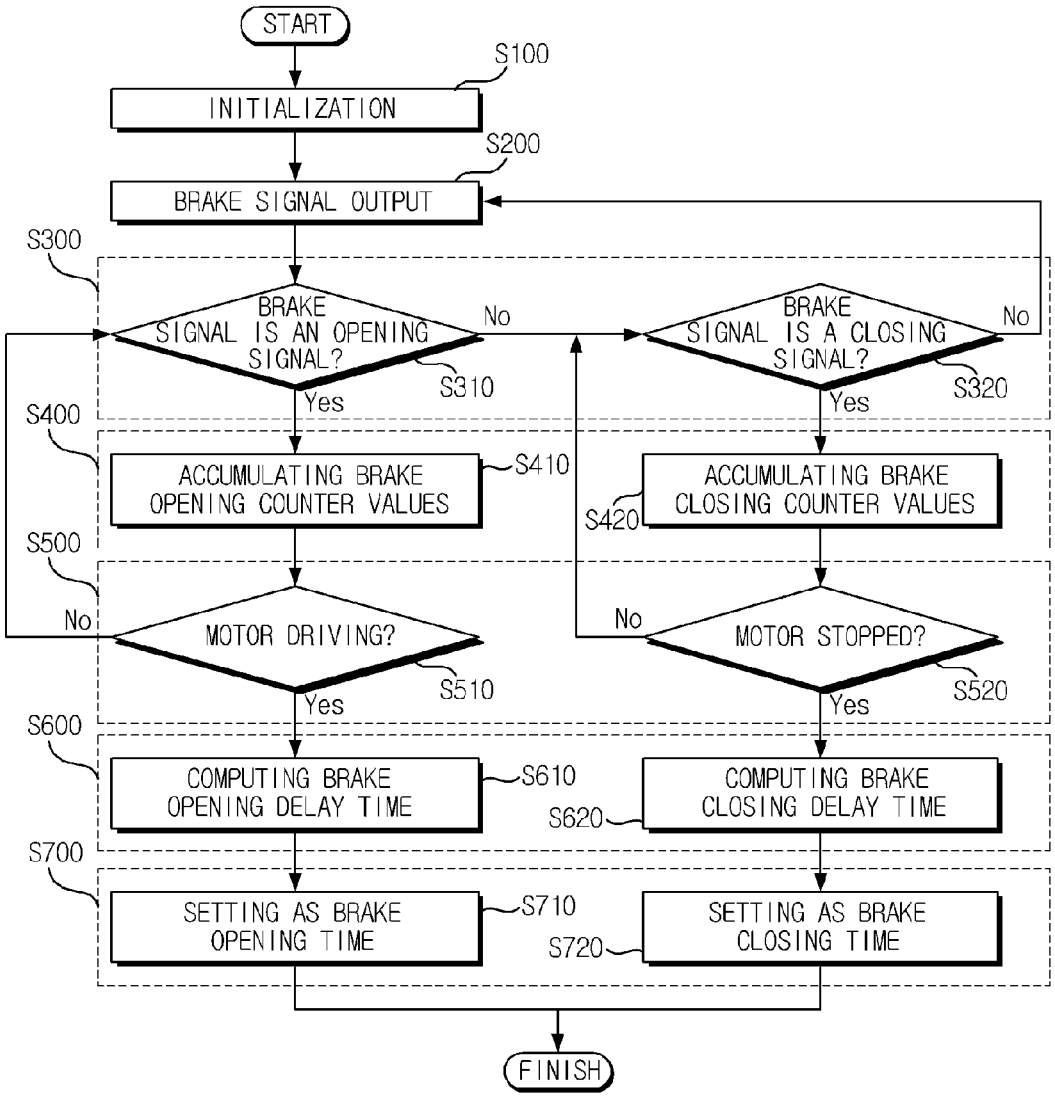
FIG. 2 is a flow chart illustrating a method for measuring an opening/closing delay time of elevator brake according to an exemplary embodiment of the present disclosure.

FIG. 1 is a block diagram illustrating a system for measuring an opening/closing delay time of elevator brake according to an exemplary embodiment of the present disclosure, and FIG. 2 is a flow chart illustrating a method for measuring an opening/closing delay time of elevator brake according to an exemplary embodiment of the present disclosure.

Referring to FIG. 1, the system for measuring an opening/closing delay time of elevator brake according to an exemplary embodiment of the present disclosure may include an initialization unit (10), a brake signal output unit (20), a brake signal checking unit (30), a brake counter unit (40), a motor drive checking unit (50), and a brake opening/closing delay computation unit (60).

The initialization unit (10) initializes a counter value and a variable recorded by a prior-processed measurement in measuring an elevator brake opening/closing delay time, and particularly, initializes a counter value recorded by the brake counter unit (40). Thus, in case of measuring an elevator brake opening/closing delay time, measurement of elevator brake opening/closing delay time can be accurately implemented by preventing from being influenced by the prior-processed measurement.

The brake signal output unit (20) outputs a brake signal for controlling an operation of elevator brake, where the brake signal may be an opening signal for opening an elevator brake or a closing signal for closing an elevator brake. The brake signal checking unit (30) receives the brake signal outputted from the brake signal output unit (20) to determine whether the brake signal is an opening signal or a closing signal, and outputs an opening/closing determination signal to the brake counter unit (40).

At this time, the brake signal checking unit (30) outputs an opening determination signal when the brake signal is an opening signal and outputs a closing signal when the brake signal is a closing signal. The brake counter unit (40) receives the opening/closing determination signal outputted from the brake signal checking unit (30), starts counting for measuring a brake opening time or a brake closing time, accumulates the counted values and outputs the accumulated counted values. At this time, the brake counter unit (40) may include a brake opening counter unit (41) and a brake closing counter unit (43).

The brake opening counter unit (41) receives the opening determination signal from the brake signal checking unit (30), starts to open-count for measuring a brake opening time, and accumulates and outputs the opening counter values, and the brake closing counter unit (43) receives the closing determination signal from the brake signal checking unit (30), starts to close-count for measuring brake closing time, and accumulates and outputs the closing counter values.

Thus, the brake signal checking unit (30) outputs an opening determination signal to the brake opening counter unit (41) when the brake signal is an opening signal, and outputs a closing determination signal to the brake closing counter unit (43) when the brake signal is a closing signal.

The motor driving checking unit (50) determines whether a motor configured to drive the elevator is driven by receiving the counter values form the brake counter unit (40), and outputs a driving determination signal to the brake opening/closing delay time computation unit (60).

At this time, the motor driving checking unit (50) outputs an operation determination signal to the brake opening/closing delay time computation unit (60) when the motor is driven, and outputs a stop determination signal to the brake opening/closing delay time computation unit (60) when motor is stopped. Meantime, a case where the motor driving check unit (50) outputs the operation determination signal is when the elevator starts the operation in a stationary state, and a case where the motor driving check unit (50) outputs the stop determination signal is when the elevator stops the operation after operating the elevator.

The brake opening/closing delay time computation unit (60) computes the opening/closing delay time by receiving the driving determination signal from the driving motor checking unit (50) and receiving the accumulated counter values from the brake counter unit (40). The brake opening/closing delay time computation unit (60) may include a brake opening delay time computation unit (61) and a brake closing delay time computation unit (63). The brake opening delay time computation unit (61) computes the brake opening delay time by receiving an operation determination signal from the motor driving checking unit (50) and by receiving the opening counter value from the brake opening counter unit (41).

At this time, the brake opening delay time is a time from a point where a brake signal is outputted from the brake signal output unit (20) to a point where the motor is driven. The brake closing delay time computation unit (63) computes the brake closing delay time by receiving a stop determination signal from the motor driving checking unit (50) and by receiving a closing counter signal from the brake closing counter unit (43). At this time, the brake closing delay time is a time from a point where a brake signal is outputted from the brake signal output unit (20) to a point where the motor is stopped. Meantime, the brake opening/closing delay time computed by the brake opening/closing delay time computation unit (60) is set at a time a brake is opened and closed.

Hereinafter, a method for measuring an opening/closing delay time of elevator brake using the system for measuring an opening/closing delay time of elevator brake thus illustrated in FIG. 1 will be explained with reference to FIG. 2.

First, an initializing step for initializing the system for measuring an opening/closing delay time of elevator brake according the present disclosure is realized (S100). The initializing step (S100) may be selectively implemented by a user in order to accomplish an accurate delay time measurement by preventing influence affected to a delay time measurement process to be currently implemented through initialization of counter values and variables recorded while going through the afore-made delay time measurement process.

Subsequent to the initialization step (S100), a brake signal output step (S200) is implemented that outputs a brake signal by the brake signal output unit (20). At this time, the brake signal is outputted from the brake signal output unit (20) in order to control the operation of the elevator brake, and is outputted as any one of an opening signal or a closing signal.

Subsequent to the brake signal output step (S200), a brake signal determination step (S300) is made where the brake signal checking unit (30) receives the brake signal, determines whether the received brake signal is an opening signal or a closing signal and outputs an opening/closing determination signal.

To be more specific, the brake signal checking unit (30), in the brake signal determination step (S300), outputs an opening determination signal as an opening/closing determination signal when the brake signal is an opening signal, and outputs a closing determination signal as an opening/closing determination signal when the brake signal is a closing signal.

At this time, in the present exemplary embodiment, a determination is first implemented to determine whether the brake signal is an opening signal (S310), and determination is made as to whether the brake signal is a closing signal when the brake signal is not an opening signal (S320). However, conversely, a determination is first made as to whether the brake signal is a closing signal, and then a determination is made later as to whether the brake signal is an opening signal when the brake signal is not a closing signal.

Subsequent to the brake signal determination step (S300), a counter execution step (S400) is implemented where the brake counter unit (40) receives the opening/closing determination signal, starts the counting for measuring a brake opening time or a brake closing time, accumulates the counter values and outputs the accumulated counter values.

To be more specific, the brake counter unit (40), in the count implementation step (S400), receives an opening determination signal from the brake signal checking unit (30), starts an opening count for measuring a brake opening time, accumulates an opening counter value (S410), and outputs the accumulated opening counter values. Furthermore, the brake counter unit (40) receives a closing determination signal from the brake signal checking unit (30), starts a closing count for measuring a brake closing time, accumulates a closing counter value (S420), and outputs the accumulated closing counter values.

Subsequent to the count implementation step (S400), as the motor driving checking unit (50) receives the counter values, a determination is made as to whether a motor for driving the elevator is driven, and a driving determination step (S500) is implemented to output a driving determination signal.

To be more specific, when the motor driving unit (50) receives an opening counter value from the brake counter unit (40) in the driving determination step (S500), the motor driving unit (50) determines whether a motor is driven (S510), and outputs an operation determination signal as a driving determination signal when it is determined that the motor is driven. At this time, when the motor is not driven, flow returns to the brake signal determination step (S300) to determine whether the brake signal is an opening signal (S310). Furthermore, when a closing counter value is received from the brake counter unit (40), the motor driving unit (50) determines whether the motor is stopped (S520), and outputs a stop determination signal as a driving determination signal when it is determined that the motor is stopped (S520).

At this time, when it is determined that the motor is not stopped, flow returns to the brake signal determination step (S300) to determine whether the brake signal is a closing signal (S320).

Subsequent to the driving determination step (S500), a delay time computation step (S600) is implemented, where the brake opening/closing delay time computation unit (60) receives a driving determination signal from the driving motor checking unit (50) and receives a counter value from the brake counter unit (40) to compute the brake opening/closing delay time.

To be more specific, the brake opening/closing delay time computation unit (60), in the delay time computation step (S600), receives an operation determination signal from the driving motor checking unit (50), and receives an opening counter value from the brake counter unit (40) to compute the brake opening delay time. Furthermore, the brake opening/closing delay time computation unit (60) receives a stop determination signal from the driving motor checking unit (50) and receives a closing counter signal from the brake counter unit (40) to compute a brake closing delay time.

At this time, the brake opening delay time is a time from a point where a brake signal is outputted from the brake signal output unit (20) to a point where the motor is driven. Meantime, the brake closing delay time is a time from a point where a brake signal is outputted from the brake signal output unit (20) to a point where the motor is stopped.

Meanwhile, an opening/closing setting step (S700) may be further implemented, subsequent to the delay time computation step (S600), where the brake opening delay time computed at the delay time computation step (S600) is set as a brake opening time (S710), and the brake closing delay time is set as a brake closing time (S720).

According to the exemplary embodiment of the present disclosure, although a time delayed until a brake is opened/closed is arbitrarily set by a user according to the prior art, a delay time until a motor is driven or a motor is stopped from a point where a brake signal is outputted from a brake signal output unit is systematically computed, and the computed time is set as a point where the brake is opened/closed, whereby the brake can be opened/closed at a predetermined time.

Thus, a roll-back phenomenon, where an elevator is instantly leaned to a weightier side when a brake opening/closing time is implemented earlier, can be prevented. Furthermore, an increased wear of brake lining generated by excessive delay of brake opening/closing time can be prevented to enable a stable operation of brake.

Although the method for measuring opening and closing delay time of elevator brake according to the present disclosure has been described with reference to a number of illustrative embodiments thereof, it should be understood that numerous other modifications and embodiments can be devised by those skilled in the art that will fall within the spirit and scope of the principles of this disclosure.

More particularly, various variations and modifications are possible in the component parts and/or arrangements of subject combination arrangement within the scope of the disclosure, the drawings and the appended claims. In addition to variations and modifications in the component parts and/or arrangements, alternative uses will also be apparent to those skilled in the art.

What is claimed is:

1. A method for measuring opening and closing delay time of a drum type brake of a rope type elevator, the method comprising:

outputting, by a brake signal output unit, a brake control signal for brake opening/closing in order to control the brake;

outputting, by a brake signal checking unit, a brake opening control signal or a brake closing control signal by determining whether the brake control signal is a brake opening signal or a brake closing signal by receiving the brake control signal;

starting to count and outputting an accumulated count value, by a brake counter unit, while the brake counter unit receives the brake opening control signal or the brake closing control signal;

outputting, by a motor drive determination unit, a motor operation determination signal by starting a motor drive determination from an initial point having received the count value, and by checking a point in which a drive state of a motor driving the elevator is changed from a stop state to an operation state;

outputting, by the motor drive determination unit, a motor stop determination signal by starting a motor drive determination from an initial point having received the count value, and by checking a point in which a drive state of the motor driving the elevator is changed from an operation state to a stop state;

computing, by the motor drive determination unit, a brake opening delay time for opening the brake, using the count value of the brake counter unit at a point of the motor operation determination signal being output; and computing, by the motor drive determination unit, a brake closing delay time for closing the brake, using a count value of the brake counter unit at a point of the motor stop determination signal being output.

2. The method of claim 1, further comprising:

setting the brake opening delay time output at the opening delay time computing step as a point of the brake being opened; and setting the brake closing delay time output at the closing delay time computing step as a point of the brake being closed.

3. The method of claim 2, further comprising:

re-determining, by the motor drive determination unit, whether the brake control signal output from the brake signal output unit is a brake opening signal or a brake closing signal when no change of the motor driving the elevator is detected from a stop state to an operation state.

4. The method of claim 1, further comprising:

re-determining, by the motor drive determination unit, whether the brake control signal output from the brake signal output unit is a brake opening signal or a brake closing signal when no change of the motor driving the elevator is detected from a stop state to an operation state.

* * * * *